US005183238A

United States Patent [19]

Sorensen

[11] Patent Number: 5,183,238

[45] Date of Patent: Feb. 2, 1993

[54] CARPET STRETCHING APPARATUS PARTICULARLY FOR LONG LENGTHS OF CARPET

[76] Inventor: Brad Sorensen, 255 W. 200 North, Vernal, Utah 84078

[21] Appl. No.: 638,461

[22] Filed: Jan. 4, 1991

[51] Int. Cl.[5] ..... B65H 77/00

[52] U.S. Cl. ..... 254/209; 254/200

[58] Field of Search ..... 254/200, 205, 206, 207, 254/208, 209, 210, 211, 212

[56] References Cited

U.S. PATENT DOCUMENTS

| | | | |
|---|---|---|---|
| 70,023 | 10/1867 | Robinson | 254/211 X |
| 326,063 | 9/1885 | Sprague | 254/209 |
| 574,122 | 12/1896 | Thompson | 254/205 |
| 3,300,181 | 1/1967 | Spann | 254/212 |
| 3,693,936 | 9/1972 | Payson | 254/212 |
| 3,752,440 | 8/1973 | Ream | 254/209 |
| 3,917,225 | 11/1975 | Payson | 254/210 |
| 3,963,216 | 6/1976 | Victor | 254/209 |
| 4,509,725 | 4/1985 | Talavera | 254/212 |
| 4,538,846 | 9/1985 | Alexander | 254/209 X |
| 4,772,058 | 9/1988 | Andersen | 254/209 X |

FOREIGN PATENT DOCUMENTS

| | | | |
|---|---|---|---|
| 1421749 | 1/1976 | United Kingdom | 254/206 |

*Primary Examiner*—Daniel P. Stodolo
*Assistant Examiner*—Tony A. Gayoso
*Attorney, Agent, or Firm*—Lynn G. Foster

[57] ABSTRACT

Carpet stretching apparatus which is particularly effective in stretching long lengths of carpet taut and does not transfer the stretching force away from the stretching head to a remote location. Rather, the stretching force is transferred by a frame to a location near the stretch site, independent of the length of carpet being stretched.

2 Claims, 2 Drawing Sheets

CARPET STRETCHING APPARATUS PARTICULARLY FOR LONG LENGTHS OF CARPET

FIELD OF THE INVENTION

The present invention relates generally to the installation of carpet and more particularly to novel methods and apparatus by which carpet is stretched during installation.

RELATED ART

Installation of carpet, until the present invention, has typically involved, for example, attachment of one end edge of the carpet along a tack strip located at one wall of a room. Thereafter, particularly in a long room, a short knee-kicking device is used to take slack from the carpet. Stretching is facilitated by abutting the proximal end of a conventional telescopic stretching apparatus against the mentioned room wall and placing a manual toothed distal stretching head adjacent the opposite room wall. A stretching force is manually applied through the head to the carpet engaged by the teeth of the head. An equal and opposite force is transmitted along telescopic poles to the distal end of the stretching apparatus. The amount of force which may be applied to stretch the carpet is, therefore, a function of the strength and stability of the telescopic pole.

In long rooms, the instability of a long pole of telescopically-connected sections becomes unacceptable and stretching is seriously inadequate. Attempts to alleviate these long room problems have included placing stabilizing brackets over the pole at spaced intervals and placing nails in holes in the brackets and driving them through the carpet into the subfloor. This approach often causes damage to the carpet at the nail penetration site, and is not useable where the subfloor is concrete or the like.

BRIEF SUMMARY AND OBJECTS OF THE INVENTION

In brief summary, the present invention overcomes or substantially alleviates the above-mentioned related art problems and comprises novel carpet stretching methods and apparatus which is particularly effective in fully stretching long lengths of carpet and does not transfer the stretching force away from the stretching head to a remote location. Rather, the stretching force is transferred to a location near the stretch site, independent of the length of carpet being stretched.

With the foregoing in mind, it is a primary object of the present invention to overcome or substantially alleviate problems of the related art.

Another object of significance is the provision of novel carpet stretching methods and apparatus.

A further dominant object is the provision of novel carpet stretching methods and apparatus particularly useful in fully stretching long lengths of carpets.

Another important object is the provision of novel carpet stretching methods and apparatus wherein the stretching force is not transferred to a location remote from the stretching head.

Another paramount object is the provision of novel carpet stretching methods and apparatus wherein the stretching force is transferred to a location near the stretch site, independent of the length of carpet being stretched.

These and other objects and features of the present invention will be apparent from the detailed description taken with reference to the accompanying drawings.

DETAILED DESCRIPTION OF THE ILLUSTRATED EMBODIMENT

Figure 1:
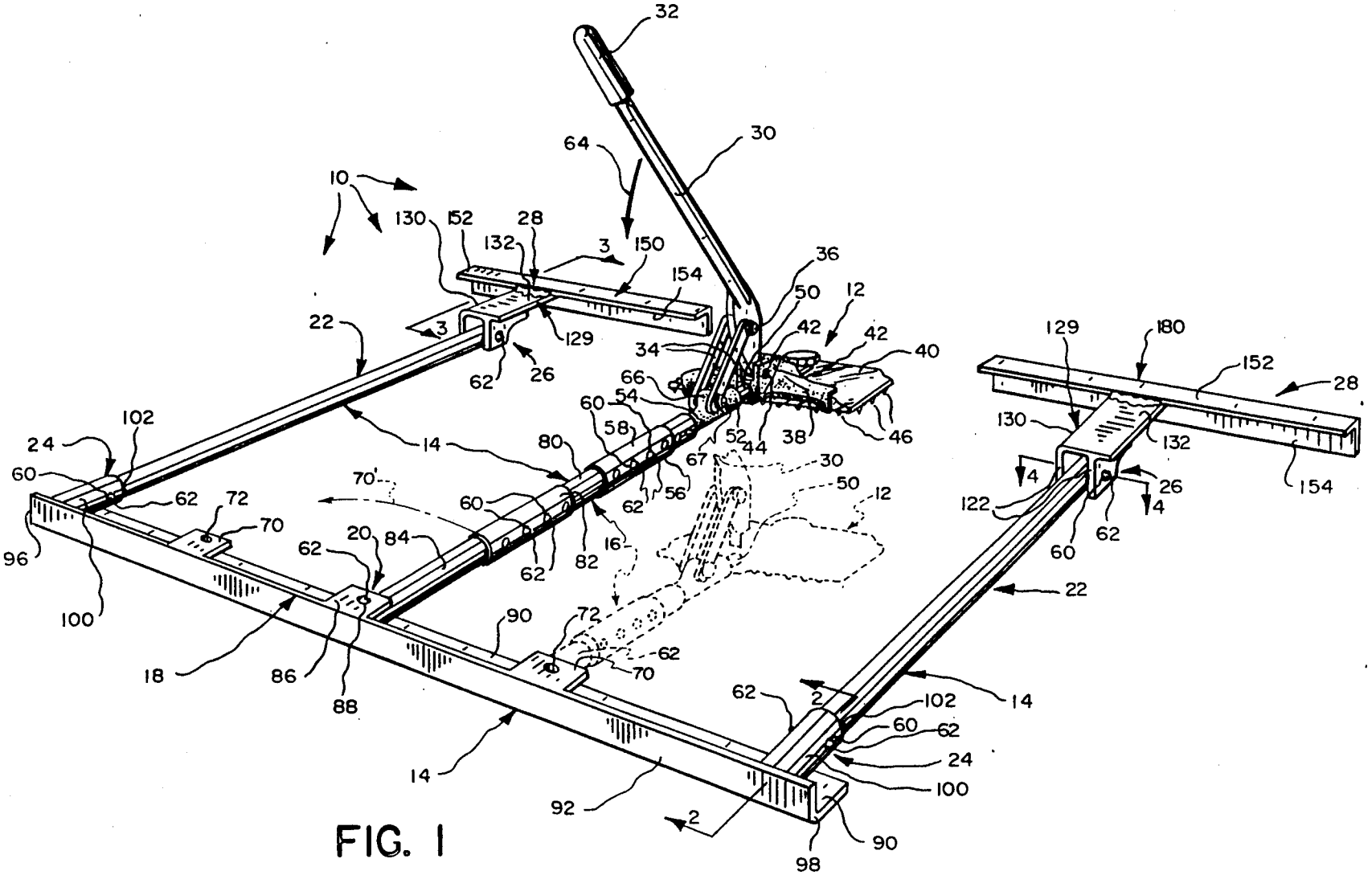
FIG. 1 is a perspective of a carpet stretching apparatus.

Reference is now made to the drawings specifically wherein like numerals are used to designate like parts throughout. The presently preferred embodiment of the invention is illustrated in FIG. 1 and generally designated 10. Mechanism 10 comprises a carpet-stretching head, generally designated 12, by which force is applied to a carpet being installed to stretch the same taut before securing it adjacent to the stretching head 12 to a tack strip previously secured to a floor upon which the carpet is being installed. The mechanism 10 also comprises a double U frame, generally designated 14, to which the stretching head is attached. The frame 14 functions to transmit the reaction force generated at stretching head 12 through 180 degrees to locations directly juxtaposed the head.

Specifically, the frame 14 comprises a central first elongated structural member, generally designated 16, comprising a plurality of telescopically interrelated poles. The distal end of member 16 is connected telescopically to the proximal end of the stretching head 12. Structural member 16 transmits a reactive force which is equal and opposite to the stretching force applied to the carpet by stretching head 12.

The frame 14 also comprises an elongated base structural member, generally designated 18, which is disposed essentially transverse or normal to the first structural member 16. The base or second structural member 18 pivotally and releasibly connects, at site 20, to the proximal end of the first structural member 16.

Frame 14 also comprises two substantially identical third structural members, each generally designated 22. Each structural member 22 is illustrated as being tubular and is releasibly connected at the distal end thereof, at connection site 24, to the base or second structural member 18.

Each structural member 22 is pivotally and releasibly connected at the proximal end thereof, at sites 26, to a tack strip-engaging shoe, generally designated 28. The two shoes 28 constitute the proximal ends of the mechanism 10. Approximately one-half of the reactive force is tensilely transmitted along structural members 22 and across the shoes 28 to a tack strip 160 (FIG. 3) installed upon a floor adjacent the stretching head 12, where carpet is being installed.

It is to be appreciated that the mechanism 10 is adapted to be placed so as to rest on the top surface of the carpet being installed adjacent an edge of the carpet typically near a wall in a room. The mechanism 10 is used to apply tension to the carpet after an edge of the carpet opposite from and remote is respect to the stretching head 12 has been secured to a tack strip fastened to the floor in said room, typically adjacent another wall of the room. The mechanism 10 is able to distribute the reactive force from the stretching head 12 in such a way that the instability and force-reducing problems of the past are essentially eliminated and all the force necessary to stretch the carpet taut, independent of the length of the room and the length of the carpet being installed, can be applied by use of the mechanism 10.

The stretching head 12 is conventional, commercially available and comprises a manual handle 30, which comprises a gripping site 32. Handle 30 is pivotally secured to a pair of parallel links 34, at pivot-formed bolt site 36. The handle 30 is also pivotally secured, at site 44, to a frame 38 of a stretch plate 40. Frame 38, more specifically, defines a pair of spaced, parallel lugs 42, each of which is apertured at 45, with the two apertures 45 being aligned. The spacing between the lugs is such as to snugly though pivotally receive the lowest end of the handle 30. Handle 30 also is apertured at its lowest end in alignment with the lug apertures. A pin 44 is inserted through the three aligned apertures whereby the handle 30 may be pivoted in respect to the frame 38. The stretching plate 40, at its lower surface, defines a plurality of pointed carpet-engaging fingers 46 which, during use, are extended through the carpet including the fabric base thereof to accommodate stretching.

The stretching head 12 also comprises a short shaft 50, which is cylindrical in its configuration. Shaft 50 is rigidly attached to the frame 38 between the lugs 42 below the pin 44 so as to be nonrotatable in respect thereto.

The stretching head also comprises a hollow tubular housing 52 into which the short shaft 50 telescopically and reciprocably fits. Reciprocation of the shaft 50 occurs as explained hereinafter. The housing 52 also comprises a proximal male end 54, which extends into the hollow distal end 56 of a sleeve 58 comprising part of the first structural member 16. Sleeve 58 is sized and shaped so as to snugly receive the trailing end 54 of the housing 52. Trailing end 54 comprises two spring-biased detent buttons 62 which oppositely project through apertures 60 in the sleeve 58, to releasibly secure the housing 52 to the sleeve 58 against relative rotation and against relative axial displacement.

It is to be appreciated that the stretching head 12 is operated by lifting the stretch plate 40 away from the carpet and displacing the handle 30 to its most erect position. Thereafter, the stretching plate 40 is returned to the carpet, accommodating penetration by pointed teeth 46 of the carpet including the backing thereof. The handle 30 is then manually rotated from its most erect position downwardly, as indicated by arrow 64 in FIG. 1. This handle rotation is accommodated by pivoting at sites 36 and 44. The spaced bars 34 are pivotally connected at their lower ends to opposite sides of a single lug 66 rigidly forming a part of the housing 52. This pivotal connection comprises pivot bolt 67 which passes aligned apertures in the lower ends of bars 34 and in the lug 66.

Housing 52 does not move at all, due to the static nature of the frame 14, as hereinafter more fully explained. However, the pivoting of the handle 30 about pivot sites 36, 44 and 67, in its downward motion causes the stretching plate 40 to move from left to right as viewed in FIG. 1 to stretch the carpet. Specifically, short shaft 50 is progressively extended from its previous substantially concealed disposition within housing 52 until the stroke of the handle 30 has been completed or until maximum carpet force for stretching has been applied to the carpet. In certain installations, particularly long ones, it may be necessary to repeat the above-described stretching procedure two or more times to bring the carpet to a satisfactory taut condition, depending on how slack the carpet is to begin with and how much stretch is needed.

Also, the stretching head 12, while shown in FIG. 1 as being disposed along the central axis of the mechanism 10 equal distance between and parallel to members 22, may be pivoted about site 20 left and/or right of center to angularly pull the carpet as described, until a taut condition is achieved.

Also, it should be appreciated that two stretching heads 12 connected to the second structural member or base 18 may be used in lieu of the one shown in solid lines in FIG. 1. For this purpose and to provide force balance, the base 18 comprises two additional lugs 70, each of which are apertured at 72. The leg 90 of base 18 is also apertured to receive a detent button in alignment with each aperture 72. To use two stretching heads 12, each is equipped with a structural member 16. The central structural member 16 may be retained as illustrated in sold lines or removed from pivot connection site 20 and placed in a pivotally-retained, releasible condition at one of the two lugs 70. A second stretching head 12 and as seen in dashed lines in FIG. 1, with a structural member 16 is pivotally, releasibly connected at the proximal end of said member 16 to the other lug 70 in the manner explained above. The two stretching heads are, thereafter, manually operated in the manner described above to bring the carpet to a taut condition.

It is to be appreciated that structural members 16, 18 and 22 need not necessarily be of any particular length to achieve the objectives of the present invention. Preferably, structural members 22 are formed of conventional carpet-stretching tubular sections equipped appropriately at each end thereof with spring-loaded detent buttons and apertures for receiving the buttons. Since the buttons are all identical, each is designated by the numeral 62. Similarly, each aperture adapted to receive a button 62 is designated by the numeral 60, with the exception of aperture 72 in each lug 70.

As shown in FIG. 1, first structural member 16 comprises a central tube 80 detent connected telescopically to sleeve 58 at one end and to sleeve 82 at the other end. Sleeve 82 is likewise detent connected telescopically to tube 84. Tube 84 is pivotally and releasibly connected at site 20 to a central lug 86 of base 18 at aperture 88. An opposed detent also secures the tube 84 to leg 90 of the base structural member 18 at a detent button receiving aperture therein.

Figure 2:
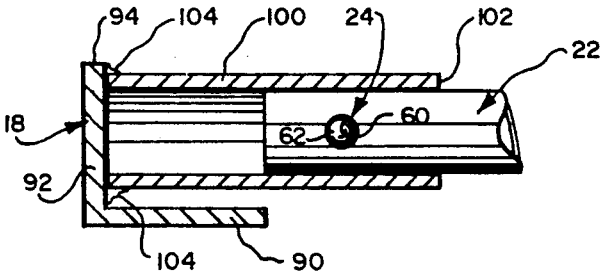
FIG. 2 is a fragmentary cross section of a lateral base member at a site of attachement to a longitudinal support member.

As is best seen in FIG. 2, base member 18 is illustrated as being a standard angle structural steel member, with certain modifications. As such, base structural member 18 comprises the previously mentioned horizontally-disposed leg 90 and vertically-directed, integral leg 92. Lugs 70 and 88 are secured to leg 92 by welding adjacent the top edge 94 thereof.

Similarly, adjacent each end 96 and 98 of the base 18, a short sleeve 100 is disposed. Each sleeve 100 is illustrated as comprising a short length of steel tubing open at one end near edge 102 and secured at the other end to the interior of the vertical leg 92 of the base 18 by welding, at annular fillet 104. Each sleeve 100 centrally comprises opposed horizontally-disposed apertures 60 through which spring-biased detent buttons 62 of the associated structural member 22 extend. Thus, each sleeve 100 of the base 18 is releasibly secured to the associated structural member 22 against relative rotation or relative axial displacement. See FIG. 2.

Figure 4:
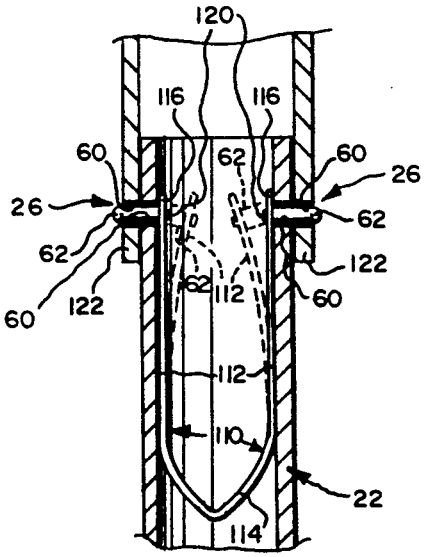
FIG. 4 is a fragmentary cross section of the longitudinal support member showing a top view of the longitudinal support member at the site of attachment to the shoe member.

Reference is now made to FIG. 4. Each tube 22 is pivotally connected at the proximal end thereof along a horizontal pivot axis to a previously mentioned tack strip-engaging shoe 28. This pivotal connection is at site 26, the details of which are illustrated in FIG. 4. It is to be appreciated that the explanation, in respect to FIG. 4, of the detent mechanism applies equally to all other sites where a spring-biased detent button is shown and described.

More particularly, FIG. 4 illustrates a generally U-shaped spring member generally designated 110. Spring member 110 is formed of spring steel with memory and comprises parallel elongated legs or leaves 112 which are interconnected by an integral 180 degree bridge segment 114. Preferably, the unstressed spacing between legs 112 is slightly greater than the inside diameter of the associated tubular structure member 22. Thus, when the detent spring member 110 is fitted into an end of the tubular structural member 22, the legs 112 are lightly stressed through a slight displacement toward each other. Each leg 112 comprises a free deflectable end 116.

Adjacent to each free end 116 is disposed a detent button 62, extending radially outwardly. Two oppositely directed detent buttons 62 are illustrated in FIG. 4, each being secured to the associated spring leaf 112 by an enlarged rivet head 120, the diameter of which is larger than an aperture in the spring leg 112 through which the rivet was initially extended before the head 120 was enlarged. Consequently, each detent button 62 is integral with and spring-biased radially outwardly by the associated spring leaf 112. Each spring leaf 112, however, is highly yieldable so that the opposed detent buttons 62 may be manually displaced from the solid line position of FIG. 4 to the dotted line position to prevent button detent interference during assembly and disassembly of the associated members.

It is to be appreciated that when either tube 22 is disassembled from the frame 14, and detent buttons 62 are not manually displaced, each detent button will project outwardly through its associated aperture 60 in the wall of the tube 22, with the associated spring leaf 112 disposed contiguously with the inside surface of the tube 22.

Similarly, when the appropriate end of one tube 22 is telescopically placed between spaced ears 122 of the associated shoe 28, with the two detent buttons 62 depressed initially to accommodate such displacement, the detent buttons 62, responsive to the memory of the associated spring leaves 112 will bias the detent button 62 so that when the detent buttons 62 are aligned with the apertures 60 in the ears 122, the detent buttons 62 will be displaced to the positions shown in solid lines in FIG. 4 to thereby retain the tube 22 and the associated shoe 28 together in a relationship which prevents relative axial displacement of the two absent depression of the detent buttons 62, but accommodates pivoting of the shoe 28 about a horizontal axis which passes through buttons 62.

Each shoe 28, in addition to comprising two ears 122 which have a depth greater than the diameter of the associated tube 22 and are spaced from each other a distance slightly greater than the outside diameter of the associated tube 22, comprise a short length of standard structural steel angle comprising a downwardly-directed vertical leg 130 (part of which comprises one lug 122) and a horizontal-directed integral leg 132. See FIG. 3. In the illustrated configuration, the additional lug or ear 122 is welded along its upper edge to the underside of the horizontal leg 132 into the depending position illustrated in FIG. 1.

Figure 3:
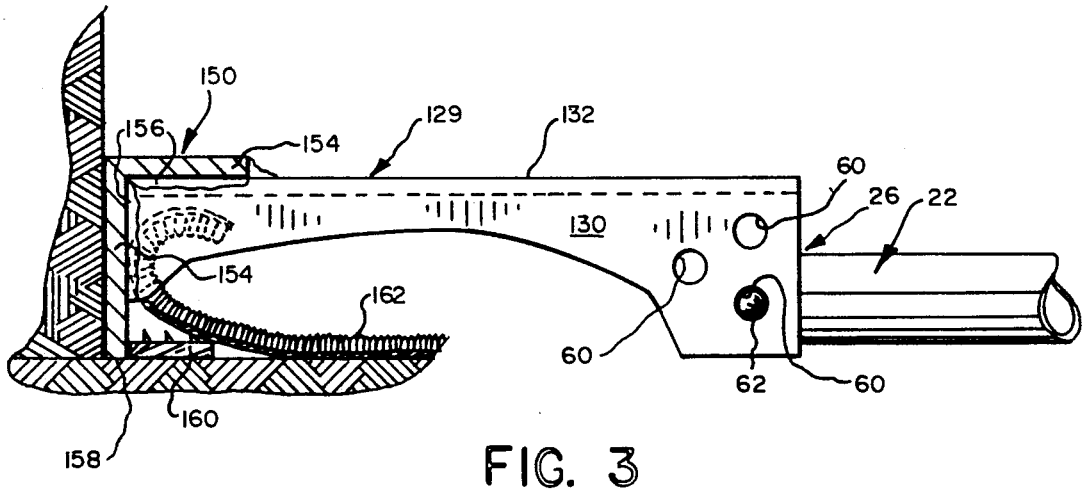
FIG. 3 is a cross section of a shoe member showing a side view of the shoe member at a site of attachment to the longitudinal support member.

As best seen in FIG. 3, each ear 122 has three apertures 60 therethrough disposed at different elevations. Each aperture 60 of one ear 122 is in horizontal alignment with one of the apertures 60 of the other ear 122 so that opposed detent buttons may be placed in any two aligned apertures 60 in the ears 122. Thus, for carpet having a relatively small depth, the opposed detent buttons 62 may be placed in the lower set of apertures 60, for medium-depth carpet in the middle set of apertures 60, and for thick carpet in the top set of apertures 60. The detent buttons 62 carried at the proximal end of each tube 22 are shown as being disposed in the lower two apertures 60 of the spaced ears 122 in the Figures.

Also, independent of the depth of the carpet, in order for each shoe 28 to be placed so as to correctly engage an installed tack strip 160 (FIG. 3), the bulk of the carpet may make it desirable to locate the detent buttons carried at the proximal end of the tubes 22 in the intermediate or high set of apertures 60 in the ears 122 in order to provide appropriate transfer of the reactive force caused by displacement of the stretching head 12.

Each shoe 28 also comprises a transversely-directed tack strip-engaging member 150. Each member 150 is illustrated as extending an equal distance to each side of the associated shoe member 129 and, as illustrated, comprises a standard angle structural steel member comprising horizontal leg 152 and integral vertical leg 154. The proximal end of each member 129 is fitted contiguously under the horizontal leg 152 with the proximal edge thereof disposed against the leg 154 of the associated shoe member 150 and welded at sites 156 to the associated member 150. See FIG. 3.

Vertical leg 154 of each member 150 comprises a lower edge 158. Edge 158 is caused to engage the floor surface adjacent a wall behind an installed tack strip 160 (FIG. 3) prior to use so that the reactive force from the stretching head 12 is transmitted in part through each member 16 and from thence to each shoe 28 where at two-spaced sites each leg 154 engages tack strip 160. As the stretching head 12 is operated, as previously explained, excess carpet is displaced toward the two legs 154, sometimes causing the carpet 162 (FIG. 3) to curl as illustrated in FIG. 3. Ultimately, when the carpet has been stretched taut, the carpet edge adjacent to the legs 154 is appropriately trimmed and caused to be secured upon top-pointed spikes of the tack strip 160, as is well known.

Figure 5:
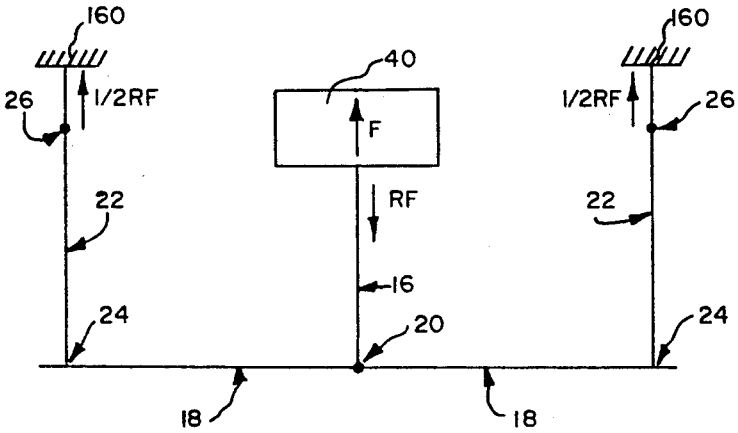
FIG. 5 is a diagrammatic showing force distribution through the carpet stretching apparatus.

Reference is made to FIG. 5 which illustrates the application of a force, having a magnitude of F, applied by stretching plate 40 to stretch the carpet. This causes an equal and opposite reactive force RF at stretching plate 40 to be compressively transmitted through structural member 16. Approximately one-half of the reactive force is transmitted to the left along base member 18 and the other half to the right along base member 18 to and tensilely through the opposed structural members 22 and from thence via legs 154 to tack strips 160. Accordingly, no matter how large the room or how long the carpet may be which is installed using mechanism 10, the carpet is placed in a thoroughly taut condition without encountering the instability and reduction in force applied problem of the past, to thereby provide an improved carpet installation.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An apparatus for stretching carpet taut across a floor of an entire room from a single general location independent of the dimensions of the floor comprising a spikeless frame comprising a base which only rests upon, but does not otherwise engage the carpet, the frame further comprising two broad hooks for engaging a back edge of a tack strip secured to the floor near a wall of the room, two side members, one broad hook being attached to each side member, each side member comprising an underside comprising part of said base, a cross member connected to the two side members at respective locations remote from the broad hooks, the cross member comprising at least one carpet stretcher connection site, the spikeless frame defining a large unobstructed area between the side members and the cross members and the tack strip;

a carpet stretcher comprising a spiked stretching head for spike engagement and applying stretching force to a plurality of specific carpet locations within the unobstructed area without relocation of the frame and a support member spanning between the stretching head and the connection site in a plane generally parallel to the carpet by which each stretching force is transferred to the frame and thence through the hooks to the tack strip;

the attachment between each side member and one of the associated hooks comprising selectable connection sites to allow adjustment for variations in carpet pile height.

2. An apparatus for stretching carpet taut across a floor of an entire room from a single general location independent of the dimensions of the floor comprising a spikeless frame comprising a base which only rests upon, but does not otherwise engage the carpet, the frame further comprising two broad hooks for engaging a back edge of a tack strip secured to the floor near a wall of the room, two side members, one broad hook being attached to each side member, each side member comprising an underside comprising part of said base, a cross member connected to the two side members at respective locations remote from the broad hooks, the cross member comprising two spaced carpet stretcher connection sites, the spikeless frame defining a large unobstructed area between the side members and the cross members and the tack strip;

two carpet stretchers, each individually connected at a proximal end to the cross member at one of the spaced carpet stretcher connection sites and comprising a spiked stretching head for spike engagement and applying stretching force to a plurality of specific carpet locations within the unobstructed area without relocation of the frame and a support member spanning between each stretching head and the associated connection site in a plane generally parallel to the carpet by which each stretching force is transferred to the frame and thence through the hooks to the tack strip.

* * * * *